United States Patent [19]

Krieger

[11] Patent Number: 5,068,497

[45] Date of Patent: Nov. 26, 1991

[54] ELECTROSTATIC FILTER CABLE

[75] Inventor: Wolfgang Krieger, Obrigheim, Fed. Rep. of Germany

[73] Assignee: Abb Kabel und Draht GmbH, Mannheim, Fed. Rep. of Germany

[21] Appl. No.: 577,940

[22] Filed: Sep. 5, 1990

[30] Foreign Application Priority Data

Sep. 5, 1989 [DE] Fed. Rep. of Germany ..... 3929450

[51] Int. Cl.[5] ..... H01B 1/06; H01B 7/18

[52] U.S. Cl. ..... 174/106 R; 174/107; 174/131 A; 338/214

[58] Field of Search ..... 174/106 R, 107, 108, 174/131 A; 338/214

[56] References Cited

U.S. PATENT DOCUMENTS

| | | | |
|---|---|---|---|
| 2,325,549 | 7/1943 | Ryzowitz | 174/131 A |
| 4,130,450 | 12/1978 | Bahder et al. | 156/48 |
| 4,196,307 | 4/1980 | Moore et al. | 174/131 A X |
| 4,487,996 | 12/1984 | Rabinowitz et al. | 174/105 R |
| 4,508,934 | 4/1985 | Feldman, Jr. | 174/15.6 X |
| 4,520,230 | 5/1985 | Uesugi et al. | 174/107 |
| 4,618,453 | 10/1986 | Kim | 252/500 |
| 4,691,082 | 9/1987 | Flatz et al. | 174/106 SC |
| 4,697,001 | 9/1987 | Walker et al. | 252/500 |
| 4,929,389 | 5/1990 | Aldissi | 252/500 |

*Primary Examiner*—Morris H. Nimmo

*Attorney, Agent, or Firm*—Herbert L. Lerner; Laurence A. Greenberg

[57] ABSTRACT

An electrostatic filter cable for an electrostatic filter system includes an internal electrical conductor formed of an electrically conductive plastic with a specific resistance in a range of substantially from 2 to 200 Ω $mm^2/m$. An insulation of cross-linked polyethylene is disposed on the internal electrical conductor. An outer conductive layer is disposed on the insulation. A copper shield is disposed on the outer conductive layer. An outer PVC jacket is disposed on the copper shield.

11 Claims, 2 Drawing Sheets

ELECTROSTATIC FILTER CABLE

The invention relates to an electrostatic filter cable for an electrostatic filter system having an internal electrical conductor, an insulation of cross-linked polyethylene, an outer conductive layer, a copper shield, and an outer PVC jacket.

Such an electrostatic filter cable is known, for instance, from a Kabel + Draht publication K + D 1060D (February 1978), MGD, page 1. That electrostatic filter cable has an internal electrical conductor in the form of a round, multi-wired aluminum conductor and is used in an electrostatic filter system to connect a high-voltage-producing rectifier system to an electrical discharge wire disposed in a filter housing. The filter housing is connected to ground potential.

In electrostatic filter systems, electrical sparkovers between high-voltage potential and ground potential occur by definition. In order to damp the resultant surge voltages, damping resistors are typically introduced between the electrical discharge wire, the electrostatic filter cable and the high-voltage-producing rectifier system. This makes the electrostatic filter system quite complicated.

It is accordingly an object of the invention to provide an electrostatic filter cable, which overcomes the hereinaforementioned disadvantages of the heretofore-known devices of this general type and with which the structure of the electrostatic filter system can be simplified.

With the foregoing and other objects in view there is provided, in accordance with the invention, an electrostatic filter cable for an electrostatic filter system, comprising an internal electrical conductor formed of an electrically conductive plastic with a specific resistance in a range of substantially from 2 to 200 $\Omega$ mm$^2$/m, an insulation of crosslinked polyethylene disposed on the internal electrical conductor, an outer conductive layer disposed on the insulation, a copper shield disposed on the outer conductive layer, and an outer PVC jacket disposed on the copper shield.

The advantages attainable with the invention are in particular that through the use of the proposed electrostatic filter cable, damping resistors between the electrical discharge wire, the electrostatic filter cable and the rectifier system no longer need to be provided. The proposed electrostatic filter cable takes on not only the function of carrying high voltage to the electrical discharge wire but also that of damping the excess voltages occurring in the sparkovers that by definition occur in the electrostatic filter system. Since plastic is used for the internal electrical conductor, the weight of the electrostatic filter cable is advantageously reduced and handling is simplified as well. If the tensile strength of the proposed electrostatic filter cable should prove inadequate, then materials with tensile strength may additionally be incorporated into the internal electrical conductor.

In accordance with another feature of the invention, the internal electrical conductor is formed of a conductive polymer.

In accordance with a further feature of the invention, the internal electrical conductor is formed of a polypyrrol.

In accordance with an added feature of the invention, the specific resistance of the internal electrical conductor is substantially 10 $\Omega$ mm$^2$/m.

In accordance with an additional feature of the invention, there is provided at least one strand of an electrically nonconductive material with tensile strength being inserted into the internal electrical conductor.

In accordance with yet another feature of the invention, the electrically nonconductive material with tensile strength is a polyamide.

In accordance with yet a further feature of the invention, the electrically nonconductive material with tensile strength is a polypropylene.

In accordance with a concomitant feature of the invention, the electrically nonconductive material with tensile strength is reinforced with glass fibers.

Other features which are considered as characteristic for the invention are set forth in the appended claims.

Although the invention is illustrated and described herein as embodied in an electrostatic filter cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
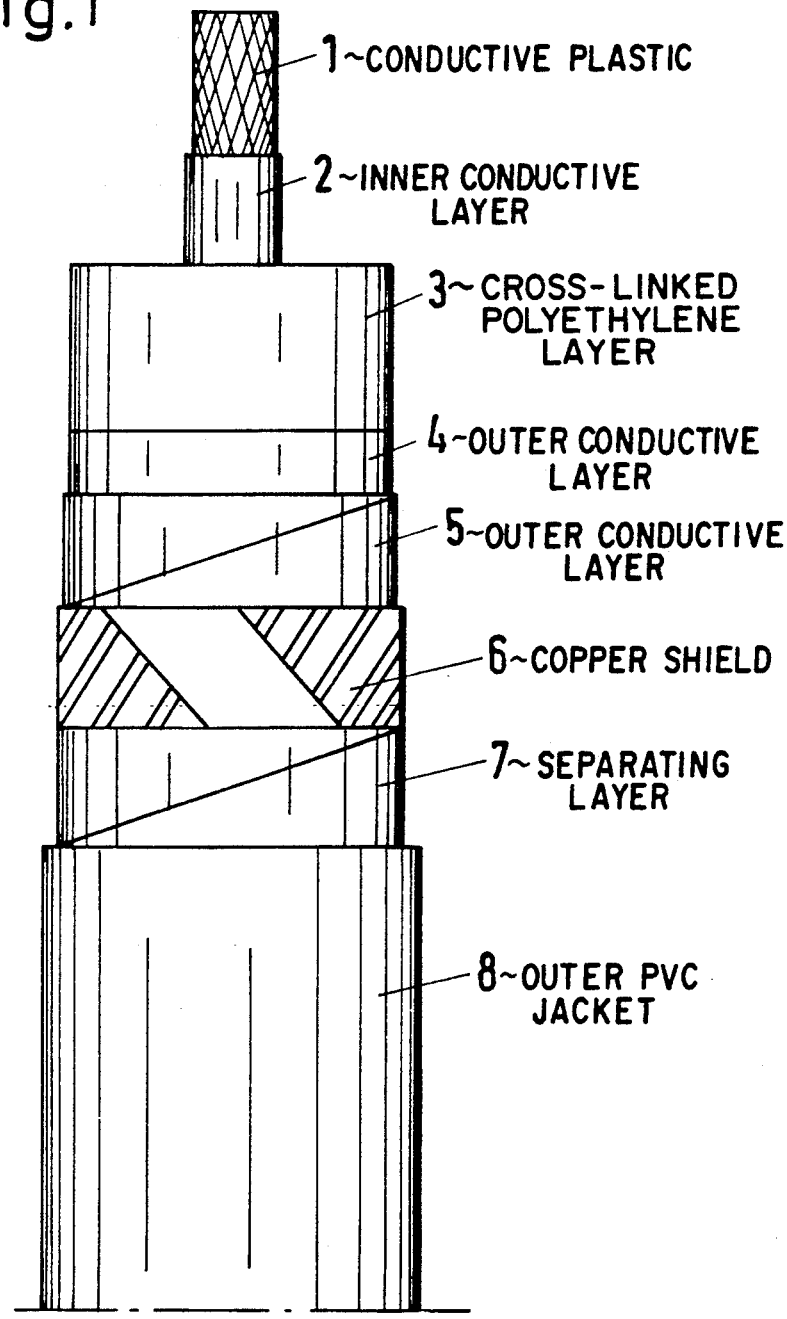
FIG. 1 is a fragmentary, diagrammatic, elevational view showing the structure of an electrostatic filter cable.

Referring now to the figures of the drawings in detail and first, particularly, to FIG. 1 thereof, there is seen a structure of an electrostatic filter cable. The electrostatic filter cable has a conductor 1 formed of an electrically conductive plastic. Depending on the resistance required, it is possible to use conductive polymers typically used in cable technology (for instance a PE copolymer), which are of the kind known for inner and outer conductive layers in cables, for instance. Polypyrrols can also be used as conductive plastics for the conductor 1. With the aid of these materials, the conductance of the conductor 1 can be variably specified within wide limits, to suit requirements. The specific electrical resistance ranges from 2 to 200 $\Omega$ mm$^2$/m and is preferably 10 $\Omega$ mm$^2$/m. However, the precise value to be selected is largely dependent on the type, structure, mode of operation and capacity of the electrostatic filter system being used.

The conductor 1 which is formed of conductive plastic may be sheathed with an inner conductive layer 2. The inner conductive layer 2 can be dispensed with if, for instance, a conductive polymer having a smooth surface is used as the conductor 1, because in that case smoothing of the conductor 1 to assure reliable control of the field intensity occurring at the surface is unnecessary. An insulation 3 of crosslinked polyethylene (XLPE) surrounds the inner conductive layer 2 or directly surrounds the conductor 1 itself. The insulation 3 is sheathed with an outer conductive layer 4 formed of an electrically conductive coating or an extruded conductive material. The outer conductive layer 4 is followed by a further outer conductive layer 5 made of a conductive tape.

The outer conductive layers 4, 5 which serve as field limiters, are sheathed with a copper shield 6 that is made of copper wires wound in the opposite direction. The copper shield 6 is followed by a separating layer 7 and an outer PVC jacket 8.

Figure 2:
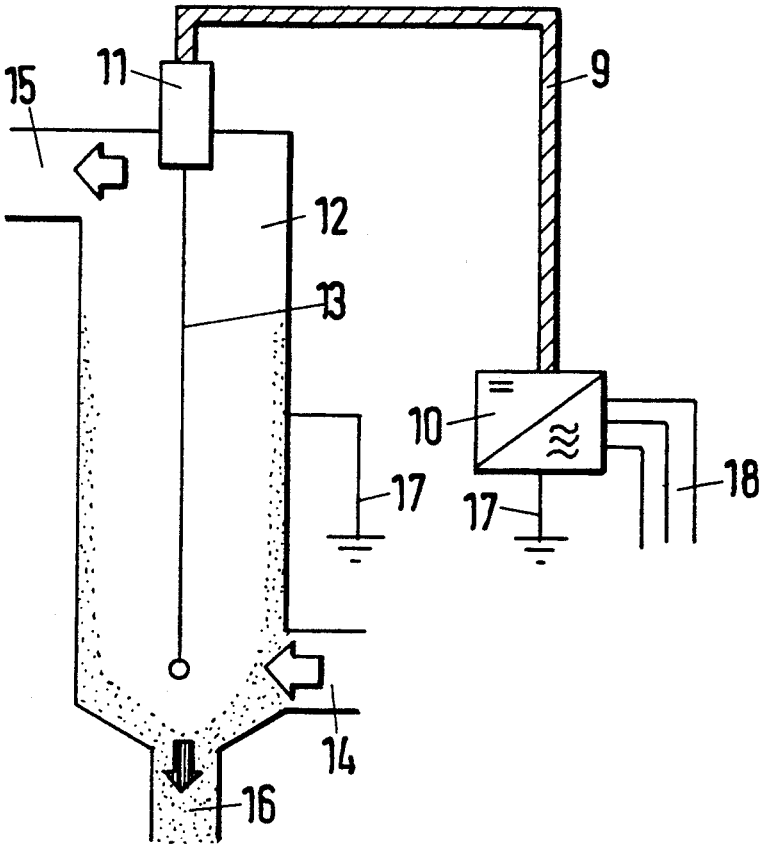
FIG. 2 is a schematic and diagrammatic view illustrating the use of an electrostatic filter cable in an electrostatic filter system.

FIG. 2 illustrates the use of an electrostatic filter cable in an electrostatic filter system. An electrostatic filter cable 9 can be seen to be connected at one end to a rectifier system 10. The other end of the cable 9 it extends through an insulator 11 into the interior of a cylindrical dust removal filter housing 12 of the electrostatic filter system, where it acts upon an electrical discharge wire 13 with high direct voltage. The metal electrically conductive housing 12 of the dust removal filter has a raw gas inlet opening 14 disposed laterally in the lower part thereof, a clean gas outlet opening 15 disposed laterally in the upper part thereof, and a dust outlet opening 16 disposed centrally in the lower part thereof. The raw gas inlet, the clean gas outlet and the dust outlet are each indicated by arrows. The dust driven out of the raw gas toward the wall of the dust removal filter housing 12 by the high direct voltage being applied, is shown as dots in the drawing. Reference numerals 17 indicate a grounding cable of the dust removal filter housing 12 and of the rectifier system 10. The rectifier system 10 is supplied from a three-phase current supply 18.

In the electrostatic filter system, electrical sparkovers occur by definition between the electrical discharge wire 13 connected to a high voltage potential, and the dust removal filter housing 12 connected to ground potential. The direct voltage increases along a charging curve of a capacitor up to the sparkover in the dust removal filter housing, and breaks down abruptly upon sparkover, whereupon the charging process begins anew. The ohmic resistance of the electrostatic filter cable 9 in this case assumes a function of a damping resistor, in order to damp the surge voltages arriving between the dust removal filter housing or electrical discharge wire 13, the electrostatic filter cable 9, and the rectifier system 10.

Figure 3:
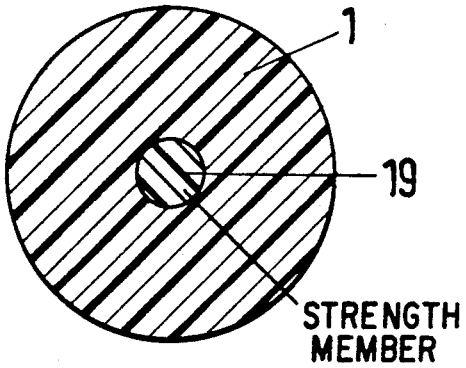
FIGS. 3 and 4 are sectional views showing various embodiments of the internal electrical conductor of the electrostatic filter cable.
Figure 4:
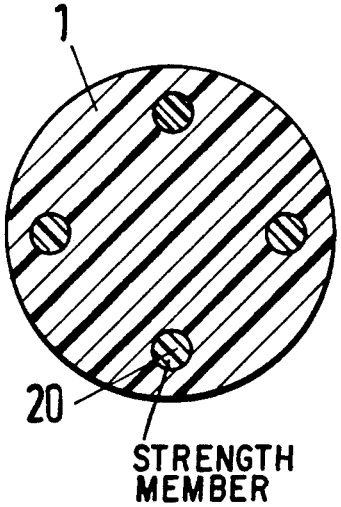

In FIGS. 3 and 4, various embodiments of the internal eleotrioal conductor of the electrostatic filter cable are shown.

The variants shown indicate that the tensile strength of the conductor 1 and therefore of the electrostatic filter cable be increased considerably. In FIG. 3, a central strand 19 is provided in the internal electrical conductor 1, while in FIG. 4 a plurality of individual strands 20, which in this instance number four, are distributed symmetrically in the conductor 1. The central strand 19 or individual strands 20 are made of an electrically nonconductive material with tensile strength, preferably an electrically nonconductive plastic of very high tensile strength, such as polyamide, polypropylene, or the like (optionally reinforced with glass fibers). Depending on the application, it may be unnecessary to provide for the additional incorporation of these materials with tensile strength, if the electrostatic filter cable equipped with a conductor 1 of conductive plastic, has a tensile strength that meets the demands made of it.

I claim:

1. Electrostatic filter cable for an electrostatic filter system, comprising an internal electrical conductor formed of an electrically conductive plastic with a specific resistance in a range of substantially from 2 to 200 $\Omega$ mm$^2$/m, an insulation of cross-linked polyethylene disposed on said internal electrical conductor, an outer conductive layer disposed on said insulation, a copper shield disposed on said outer conductive layer, and an outer PVC jacket disposed on said copper shield.

2. Electrostatic filter cable according to claim 1, wherein said internal electrical conductor is formed of a conductive polymer.

3. Electrostatic filter cable according to claim 1, wherein said internal electrical conductor is formed of a polypyrrol.

4. Electrostatic filter cable according to claim 1, wherein the specific resistance of said internal electrical conductor is substantially 10 $\Omega$ mm$^2$/m.

5. Electrostatic filter cable according to claim 1, including at least one strand of an electrically nonconductive material with tensile strength being inserted into said internal electrical conductor.

6. Electrostatic filter cable according to claim 5, wherein said electrically nonconductive material with tensile strength is a polyamide.

7. Electrostatic filter cable according to claim 5, wherein said electrically nonconductive material with tensile strength is a polypropylene.

8. Electrostatic filter cable according to claim 5, wherein said electrically nonconductive material with tensile strength is reinforced with glass fibers.

9. Electrostatic filter cable according to claim 6, wherein said electrically nonconductive material with tensile strength is reinforced with glass fibers.

10. Electrostatic filter cable according to claim 7, wherein said electrically nonconductive material with tensile strength is reinforced with glass fibers.

11. Electrostatic filter cable for an electrostatic filter system, comprising an internal electrical resistor formed of an electrically conductive plastic with a specific resistivity in a range of substantially from 2 to 200 $\Omega$ mm$^2$/m, an insulation of cross-linked polyethylene disposed on said internal electrical resistor, an outer conductive layer disposed on said insulation, a copper shield disposed on said outer conductive layer, and an outer PVC jacket disposed on said copper shield.

* * * * *